US005326003A

United States Patent [19]

Kitto et al.

[11] Patent Number: 5,326,003

[45] Date of Patent: Jul. 5, 1994

[54] APPARATUS FOR DISPENSING BEVERAGES FROM A CONTAINER

[76] Inventors: Robert Kitto, 6167 South Guthrie Rd.; Tregg Peyton, 709 Larchmont; William M. Hoag, S42 W25312 Dale Dr., all of Waukesha, Wis. 53186

[21] Appl. No.: 868,076

[22] Filed: Apr. 13, 1992

[51] Int. Cl.[5] ..... B67D 5/00

[52] U.S. Cl. ..... 222/460; 222/481.5; 222/567

[58] Field of Search ..... 222/478, 479, 481.5, 222/567, 460, 570; 220/367, 711, 713, 717; 215/309

[56] References Cited

U.S. PATENT DOCUMENTS

| | | | |
|---|---|---|---|
| 167,821 | 9/1875 | Brenner | 222/481.5 |
| 1,950,794 | 3/1934 | Hargrove | 222/478 |
| 2,061,477 | 11/1936 | Perry | 222/478 X |
| 2,545,350 | 3/1951 | Fuld | 222/460 |
| 2,605,937 | 8/1952 | Bradley | 222/570 X |
| 2,642,207 | 6/1953 | Renzi | 222/567 X |
| 2,714,977 | 8/1955 | Davis | 222/460 X |
| 3,235,133 | 2/1966 | Zimmerman et al. | 222/567 |
| 3,386,626 | 6/1968 | Kearney | 222/567 X |
| 3,430,826 | 3/1969 | Microolis | 222/570 |
| 3,537,623 | 11/1970 | Fisher | 222/460 |
| 4,120,414 | 10/1978 | Harrison et al. | 215/307 |
| 4,134,697 | 1/1979 | Sparr, Sr. | 401/276 |
| 4,260,074 | 4/1981 | Cerrato | 222/1 |
| 4,452,381 | 6/1984 | Freeman | 222/478 X |
| 4,722,463 | 2/1988 | Anderson | 222/185 |
| 4,802,610 | 2/1989 | Cheek et al. | 222/481.5 |
| 4,938,395 | 7/1990 | Jamieson | 222/478 |
| 5,104,010 | 4/1992 | Codorniz et al. | 222/479 X |

FOREIGN PATENT DOCUMENTS

| | | | |
|---|---|---|---|
| 685163 | 12/1952 | United Kingdom | 222/478 |
| 688729 | 3/1953 | United Kingdom | 222/478 |

*Primary Examiner*—Andres Kashnikow
*Assistant Examiner*—Anthoula Pomrening
*Attorney, Agent, or Firm*—Quarles & Brady

[57] ABSTRACT

A dispenser has a rubber socket with an opening at one end for fluid-tight coupling to a beverage container. An L-shaped, rigid tube has a first leg connected to receive the beverage from the socket, and a second leg with an opening about which a user's mouth can be placed to receive the beverage from the dispenser. Either the socket or the tube has an inlet opening through which a tubular plug extends. A flexible tube is attached to the inner end of the plug and projects outwardly from the open end of the socket. The tube provides passageway through which air enters the container to replace the beverage flowing out through the dispenser.

15 Claims, 2 Drawing Sheets

APPARATUS FOR DISPENSING BEVERAGES FROM A CONTAINER

BACKGROUND OF THE INVENTION

The present invention relates to dispensers for beverages and more particularly to such devices for dispensing beverages from containers, such as bottles and cans.

Many beverages such as soda, fruit juices, and beer are distributed in glass bottles having a long neck which terminates with an external lip over which a cap is fastened. The cap is removed for beverage consumption. Alternatively, a metal can is used to contain the beverage with an opening mechanism located on one end wall of the can.

To pour the beverage, the bottle is tilted at a slight angle so that the beverage does not fill the neck entirely. A can is tilted similarly so that the beverage does not entirely cover the end opening. This allows air to enter the container to replace the liquid flowing out. Tilting the container at a greater angle increases the speed of the flow as the fluid pressure at the opening is increased. However, if the container is tilted at too great an angle the liquid entirely fills the opening and air cannot continuously enter to replace the liquid which is flowing out. As a consequence, periodically the flow of liquid is interrupted while air surges into the container, thereby creating a pulsed flow of liquid. This limits the speed at which the container can be emptied.

It is often desirable to pour a beverage from a container as rapidly as possible and to do so without a pulsating flow.

SUMMARY OF THE INVENTION

An apparatus for dispensing a beverage from a container includes a resilient tubular socket having an open first end adapted to fit tightly around a mouth of the container- A rigid tubular member is connected to receive the beverage from a second end of the socket. The tubular member preferably is L-shaped with a short leg adapted to be placed partially within a user's mouth so that the beverage can flow into the mouth through a opening in that leg.

The tubular member has an air inlet to which a flexible tube is connected. The tube extends through the tubular member and the socket projecting out the first end of the socket. When the dispenser is attached to a container the tube extends through an opening into the container.

To use the dispenser, the socket is attached tightly over the neck of a bottle or around the open end of a can. The assembly is inverted so that the container is substantially vertical with its mouth pointing downward. This orientation allows the beverage to flow through the dispenser into the mouth of the user while air enters the bottle through the inlet and tube to replace the exiting beverage.

An object of the present invention is to provide a dispenser for beverages contained within a container which allows the beverage to flow through a container opening relatively fast.

Another object of the present invention is to provide a first passageway in the dispenser through which liquid can flow and a second passageway through which air can enter the container to replace the liquid which has flowed through the first passageway.

A further object of the present invention is to provide a resilient coupling element for attaching the dispenser to a container in a fluid-tight manner.

Yet another object of the present invention is to provide a spout on the beverage dispenser about which a user's mouth can be placed to receive liquid flowing through the first passageway.

DETAILED DESCRIPTION OF THE INVENTION

Figures 1, 2:
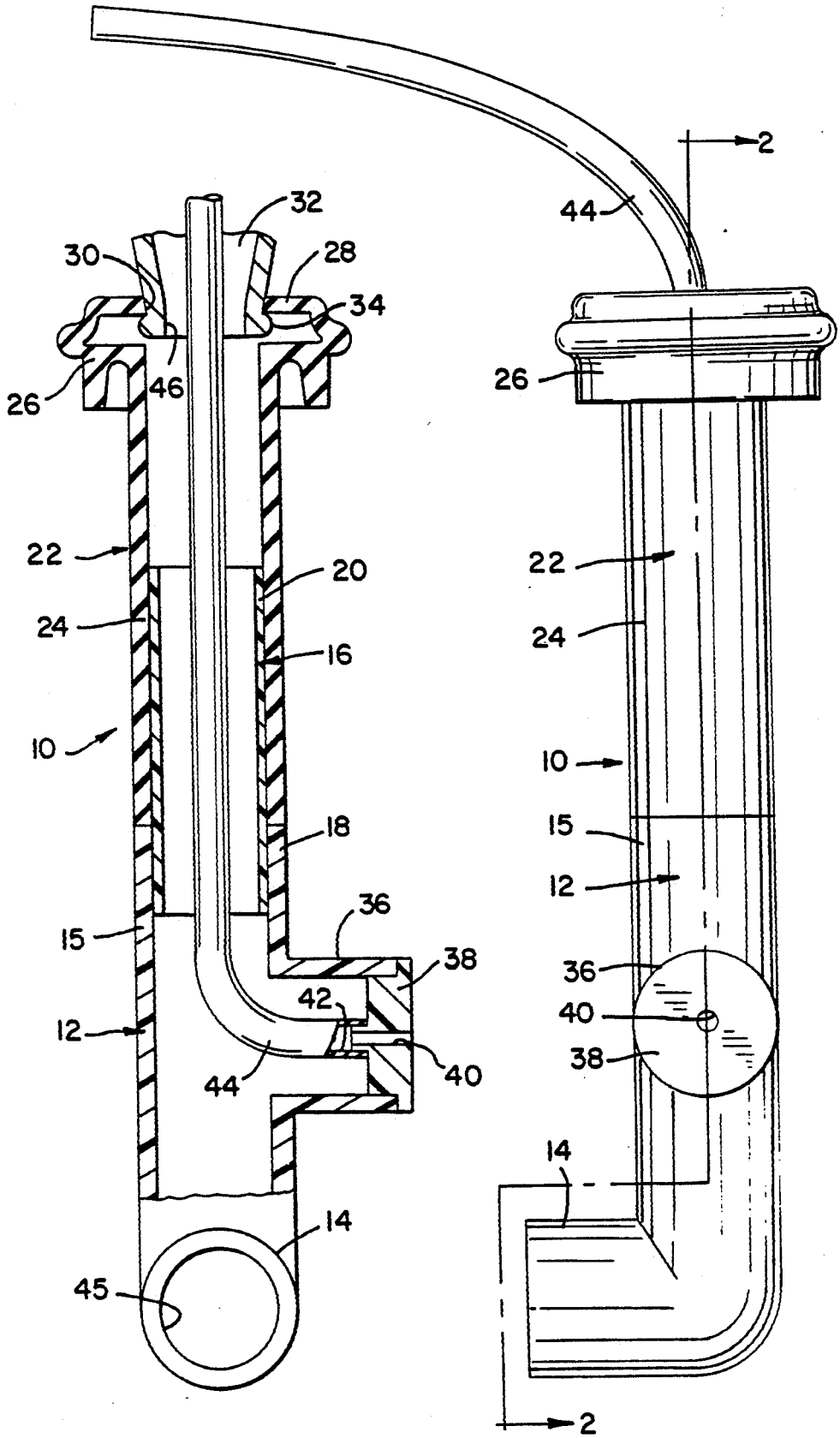
FIG. 1 is a side view of a beverage dispenser according to the present invention.
FIG. 2 is a cross sectional view taken along line 2—2 in FIG. 1 and illustrating the beverage dispenser attached to the neck of a beverage bottle.

With reference to FIGS. 1 and 2, a beverage dispenser 10 has a generally L-shaped, tubular member 12 fabricated from a rigid plastic, such as a polyvinyl chloride. The tubular member 12 has a round cross-section. A short leg 14 of the tubular member 12 has an outer diameter chosen so that a user may place the open end of the leg 14 within his or her mouth and place lips around the outer surface.

A piece of rigid plastic pipe 16 is tightly inserted into an opening at the end 18 of the tubular member 12 which is remote from the short leg 14. The pipe 16 preferably is fabricated from the same rigid plastic material as the tubular member 12. A portion 20 of the pipe 16 extends from the tubular member 12.

A socket 22 fabricated of a resilient, elastic material, such as rubber, has a round cross-sectional tubular section 24 which extends over the projecting portion 20 of the pipe. The socket 22 is slid tightly over the pipe 16, so that one end of section 24 abuts tubular member 12. This provides a fluid-tight coupling between the socket 22 and the tubular member 12.

The other end of socket section 24 has an outward flange 26 which is closed by an integral end cap 28. The end cap 28 has a centrally located circular aperture 30 therethrough which is sized to accommodate the necks of standard beverage bottles, such as bottle 32. As the end cap 28 is fabricated of elastic material, the aperture 30 can enlarge to enable the lip 34 of the beverage bottle 32 to be forced through the aperture. Smaller size beverage bottles 32 can be accommodated by inserting the neck of the bottle farther into the socket until the end cap 28 sealingly engages the outer surface of the bottle neck. In some instances the lip 34 of the beverage bottle 32 enters the tubular portion 24 of the socket 22. The elastic structure at this end of the socket 22 provides a fluid-tight seal when the dispenser 10 is attached to the bottle.

The long leg 15 of the L-shaped tubular member 12 has a lateral tubular projection 36 which communicates with the interior cavity of the member. The projection 36 has an open end within which is located a plug 38 to seal the opening and prevent fluid from flowing out through the projection 36. Plug 38 has a centrally located inlet aperture 40 therethrough which communicates with a nipple 42 extending inwardly from the plug 38. The term "plug" is used generically to cover not only an element as shown which fits within the lateral projection 36, but also a cap which fits over the end of that projection.

A flexible plastic tube 44 has one end forced around the nipple 42 providing a fluid-tight seal therebetween. The flexible tube 44 extends from the end cap 38 through the tubular member 12, pipe 16 and socket 22 exiting through the aperture 30 in the end cap 28 of the socket. The tube 44 projects from the socket 22, approximately five inches for example, with the exact distance being dependent upon the height of the bottles with which the dispenser will be used, as will be described.

In order to use the dispenser 10, an open bottle containing the beverage is placed upright. The dispenser 10 is inverted from the orientation illustrated in FIGS. 1 and 2 and the tube 44 is inserted into the neck of the bottle. The dispenser 10 then is forced downward so that the socket 22 fits tightly around the neck of the bottle. The bottle and dispenser assembly is rapidly inverted into a substantially vertical position. As this inversion occurs, the head of the user bends forward and the short leg 14 of the dispenser is placed within the mouth of the user with lips pressed tightly around the outer surface of leg 14. The L-shaped design of the dispenser 10 allows the bottle to be inverted into a vertical position for maximum flow while allowing the head of the user to remain in a normal upright position as the beverage flows into the user's mouth.

As the bottle is inverted, the beverage flows out of the neck of the bottle 32 into the socket 22. The fluid continues flowing through the socket and pipe 16 into the tubular member 12 from which it exits through opening 45 at the end of the short leg 14 and into the mouth of the user. The cross sectional area of this first passageway through which the beverage flows is approximately equal to or greater than the cross sectional area of the mouth 46 of the bottle 32. Nowhere is the first passageway narrower that the bottle mouth. This provides a beverage path that is free of obstructions, such as narrow valve orifices, which affect the rapidity of the fluid flow.

While the beverage is flowing through the first passageway, air enters inlet aperture 40 in plug 38 and flows through a second passageway formed along with the flexible tube 44. Thus, as the beverage is flowing out one passageway through the dispenser 10, air enters the bottle 32 through another passageway to replace the exiting beverage. Preferably, the length of the flexible tube 44 should be sufficient to extend entirely through the neck portion of the bottle 32, ideally extending into the uppermost portion of the bottle when it is inverted. This design enables the beverage to flow from the bottle with relative speed as it does not have to pulsate in order to allow air to enter.

In order to facilitate the user placing a mouth around the short leg 14 of the dispenser 10 without a significant amount of fluid loss, the user may place a finger over the aperture 40 in plug 38 to prevent air from entering the bottle 32 until it is in an inverted position. Once the dispensing position has been reached, the user removes the finger, allowing air to flow through the aperture 40 and into the bottle.

Figure 3:
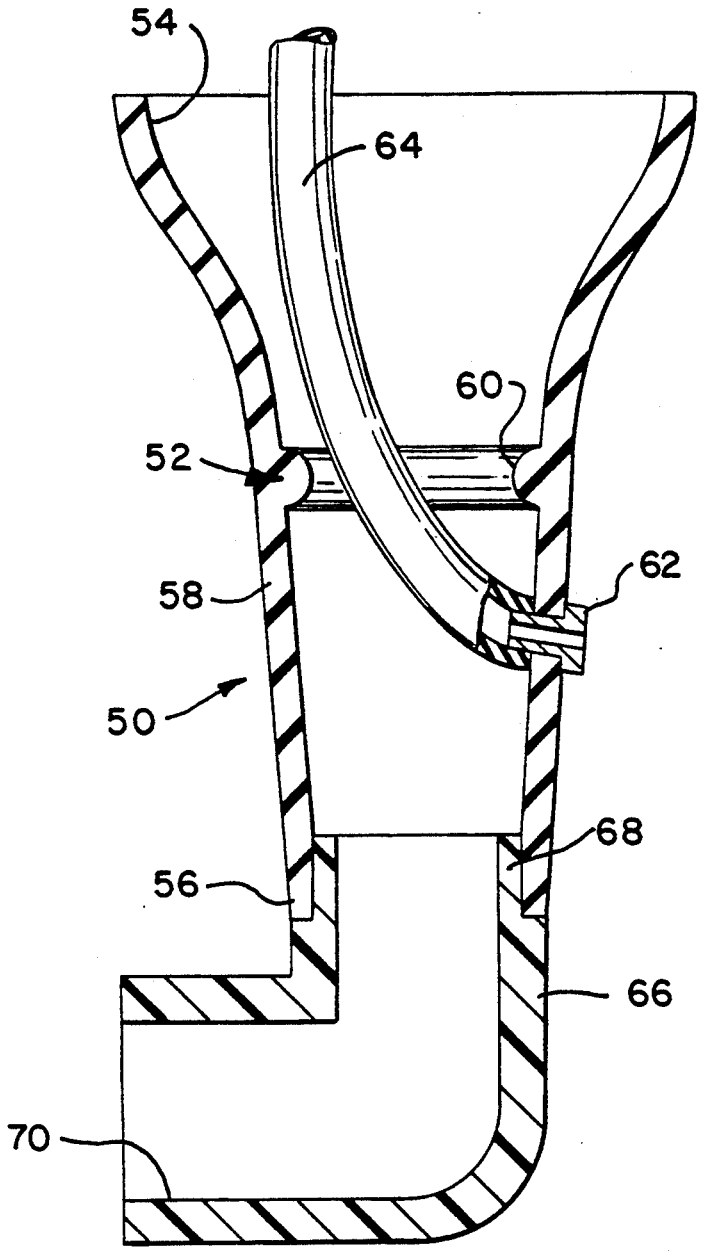
FIG. 3 is a cross-sectional view through a second embodiment of a beverage dispenser according to the present invention.

From the present description, it will be apparent to one skilled in the art that variations of the described design can be made without departing from the inventive principle. For example, the L-shaped tubular member 12 and pipe 16 can be replaced by a single molded unit having a nipple section about which the tubular portion 24 of the socket 22 fits.

with reference to FIG. 3, a second embodiment 50 of the present beverage dispenser is adapted for use with either a can or a bottle. The dispenser 50 has a funnel-shaped tubular socket 52 made out of an elastic material, such as rubber or soft plastic, for attaching the dispenser 50 to a beverage container. The socket 52 has a wide circular mouth 54 with an inner diameter that is slightly smaller than the outer diameter of a standard beverage can. This enables the socket to be stretched over the opened end of the beverage can, thereby providing a fluid-tight seal to the can. This also provides a firm attachment of the beverage dispenser 50 to the can.

The socket 52 tapers from the wide mouth 54 to a smaller diameter open end 53 forming a neck portion 58 therebetween. The socket 52 tapers rapidly inward near the mouth opening 54 so that the inner diameter of the neck portion 58 is slightly smaller than the outer diameter of the mouth on a standard beverage bottle. This enables the beverage dispenser 50 to be used alternatively by inserting the neck of an open bottle through the mouth 54 of the socket and into engagement with the inner surface of neck portion 54. An inwardly projecting ridge 60 is located around the inner surface of neck portion 58 to engage a depression around the lip of the beverage bottle. Specifically, the beverage bottle is inserted into the socket 52 so that the lip is forced past the ridge 60, which stretches as the lip passes. The combination of the elastic, snug fitting socket and the ridge 60 provide a fluid-tight seal with the neck of the beverage bottle.

Between the small end 56 of the socket 52 and the ridge 60 is an aperture through the wall of the socket. A hollow plug 62 is inserted through the aperture in the socket 52 so that a head of the plug passes against the outside surface of the socket. In this position, part of the tubular portion of the plug extends into the central opening of the socket 52. One end of a flexible plastic tube 64 is forced around the exposed portion of the plug 62 providing a fluid-tight seal therebetween. The flexible tube 64 extends from the plug 62 through the mouth 54 of the socket 52. The tube 64 projects several inches from the socket 52 and provides a similar function to that previously described for tube 44 of the dispenser 10 shown in FIGS. 1 and 2. The tubular section of plug 62 may be angled with respect to the plane of the head so as to direct the plastic tube 64 toward mouth 54.

A right angle hollow elbow 66 made of a rigid plastic material fits within the smaller end 56 of the socket 52. For that purpose, one open end of the elbow 66 has a smaller diameter nipple 68 which fits snugly within the smaller open end of the socket. The outer diameter of the nipple 68 is chosen to provide the fluid-tight seal inserted into the socket. The other end of the elbow 66 has an opening 70 about which the user's mouth may be placed. The cross-sectional area of the passage through the elbow 66 is substantially equal to the cross-sectional area of the opening in the beverage can or bottle which is inserted into the socket 52, thus providing an unrestricted passage of equivalent size between the beverage container and the mouth of the user.

Alternatively, the socket 52 and elbow 66 could be fabricated as a single piece in which case different portions of that piece would serve the same functions as the separate components illustrated in the drawing.

The second embodiment 50 of the beverage dispenser is utilized in a similar manner to that previously described with respect to the first embodiment. Specifically, the second dispenser 50 is inverted from the orientation illustrated in FIG. 3 and placed over the open end of a can or bottle until a snug engagement with that container is achieved. The combination of the dispenser 50 and the beverage container then is rapidly inverted while the user places his or her mouth about opening 70. As the inversion occurs, the liquid beverage within the container begins flowing through the socket 52 and elbow 66 into the user's mouth, while air enters the beverage container through plug 62 and tube 64. This allows air to enter through one passageway to replace the volume of beverage flowing out of the container through another passageway in the beverage dispenser 50.

Although the present invention has been described in the context of a dispenser having one end about which the user may place his or her mouth, the dispenser may also be utilized to pour the beverage from a can or bottle into another container, such as a glass.

We claim:

1. An apparatus for dispensing a beverage from a container comprising:

a first tubular member having an open end for coupling to the container and made of elastic material to stretch around the container providing a fluid-tight seal thereto, said first tubular member including a round tubular portion with the open end being formed by an outwardly projecting flange at a first end of the tubular portion and by an end cap extending across the flange, the end cap having an aperture through which a neck of a container is inserted during use of the apparatus;

a second tubular member connected at one end to a second end of the round tubular portion of said first tubular member for receiving the beverage, and having a portion with an opening about which a user's mouth can be placed to receive the beverage, one of said first and second tubular members having an inlet opening; and a tube in communication with the inlet opening, and extending through said first tubular member and projecting outward from the open end.

2. The apparatus as recited in claim 1 further comprising a plug extending across the inlet opening and having a portion that engages said tube.

3. The operation as recited in claim 1 further comprising a plug extending across the inlet opening which is located in said second tubular member, and the plug having a nipple about which said tube is coupled.

4. The apparatus as recited in claim 1 wherein said first tubular member is made of rubber.

5. The apparatus as recited in claim 1 wherein said second tubular member is made of a rigid plastic.

6. The apparatus as recited in claim 1 wherein said first and second tubular members form an interior passageway through which the beverage flows during use, and the passageway having a cross-sectional area all along the length of the passageway that is substantially at least as great as a cross-sectional area of an opening of the container.

7. An apparatus for dispensing a beverage from a bottle comprising:

a tubular socket having an opening through which the bottle is inserted during use of the apparatus, and being made of resilient material to provide a fluid-tight seal with the bottle, said tubular socket including a round cross-sectioned tubular portion, an outwardly projecting flange at a first end of the tubular portion, and a cap extending across the flange with the opening being formed through the cap;

a tubular member having a first leg with an end connected to receive the beverage from a second end of the tubular portion of said tubular socket, and a second leg extending transversely from the first leg and having an opening about which a user's mouth can be placed to receive the beverage from the apparatus, said tubular member having a tubular lateral projection with an aperture at a remote end thereof;

a plug extending across the aperture of said tubular member and having a hole therethrough; and a tube in communication with the hole in said plug, and extending through said socket and said tubular member and projecting outward from the first end of said tubular portion.

8. The apparatus as recited in claim 7 wherein said socket is made of rubber and said tubular member is made of a rigid plastic.

9. The apparatus as recited in claim 7 further wherein said plug includes a nipple about which said tube is coupled.

10. The apparatus as recited in claim 7 in which said socket and said tubular member form a passageway through which the beverage flows during use, which passageway having a cross-sectional area at all points that is substantially at least as great as a cross-sectional area at a mouth of the bottle.

11. An apparatus for dispensing a beverage from a container comprising:

a funnel shaped, first tubular section made of elastic material with a first opening at a first end through which the container is received, the first opening for providing a fluid-tight seal around an end of a beverage can, and an annular rim on an interior surface which rim for engaging a mouth of a bottle, said first tubular section having an open second end;

a second tubular section having a first opening coupled to the second end of said first tubular section for receiving the beverage, and having a portion with a second opening about which a user's mouth can be placed to receive the beverage from the apparatus for dispensing; and a tube in communication with an inlet opening in said first section and projecting outward from the first end.

12. The apparatus as recited in claim 11 further comprising a tubular plug extending across the inlet opening, and having a portion about which said tube is coupled.

13. The apparatus as recited in claim 11 wherein said first tubular section is made of rubber.

14. The apparatus as recited in claim 11 wherein said second tubular section is made of a rigid plastic.

15. The apparatus as recited in claim 11 wherein said first and second tubular sections form an interior passageway through which the beverage flows during use and the passageway having a cross-sectional are substantially at least as great as a cross-sectional area of an opening of the container all along the length of the passageway.

* * * * *